US010839628B2

(12) United States Patent
Berg et al.

(10) Patent No.: US 10,839,628 B2
(45) Date of Patent: Nov. 17, 2020

(54) VIRTUAL PANEL ACCESS CONTROL SYSTEM

(71) Applicant: Johnson Controls Technology Company, Auburn Hills, MI (US)

(72) Inventors: Timothy S. Berg, Waukesha, WI (US); Michael J. Kuzminski, Muskego, WI (US); Trivikram R. Ravada, Oak Creek, WI (US); Richard C. Sample, Sussex, WI (US); Jonathan L. Polack, Muskego, WI (US); David C. Haxton, Mequon, WI (US)

(73) Assignee: Johnson Controls Technology Company, Auburn Hills, MI (US)

( * ) Notice: Subject to any disclaimer, the term of this patent is extended or adjusted under 35 U.S.C. 154(b) by 0 days.

(21) Appl. No.: 16/178,264

(22) Filed: Nov. 1, 2018

(65) Prior Publication Data

US 2019/0080535 A1 Mar. 14, 2019

Related U.S. Application Data

(63) Continuation of application No. PCT/US2017/023410, filed on Mar. 21, 2017.

(Continued)

(51) Int. Cl.

*G07C 9/27* (2020.01)
*G07C 9/00* (2020.01)

(Continued)

(52) U.S. Cl.

CPC ..... *G07C 9/27* (2020.01); *G07C 9/00571* (2013.01); *G07C 9/00896* (2013.01); *G07C 9/23* (2020.01);

(Continued)

(58) Field of Classification Search

CPC ..... G07C 9/00103; G07C 9/00039; G07C 9/00087; G07C 2009/00095

(Continued)

(56) References Cited

U.S. PATENT DOCUMENTS 8,494,576 B1 7/2013 Bye et al.
2005/0102129 A1* 5/2005 Bond ..... G06F 9/45537 703/26

(Continued)

FOREIGN PATENT DOCUMENTS

EP 2 620 919 A1 7/2013

OTHER PUBLICATIONS

Search Report for International Application No. PCT/US2017/023410, dated Jun. 14, 2017, 10 pages.

(Continued)

*Primary Examiner* — Emily C Terrell
(74) *Attorney, Agent, or Firm* — Foley & Lardner LLP

(57) ABSTRACT

An access control system for a building or campus includes an access control host and a mobile device. The access control host is configured to interact with one or more physical control panels to monitor and control physical access to one or more locations of the building or campus. The mobile device includes a virtual panel configured to emulate one or more of the physical control panels to the access control host and perform one or more access control functions of the physical control panels. The virtual panel configures the mobile device to operate as a portable control panel in the access control system.

23 Claims, 12 Drawing Sheets

Related U.S. Application Data

(60) Provisional application No. 62/330,850, filed on May 3, 2016.

(51) Int. Cl.
*G07C 9/23* (2020.01)
*G07C 9/29* (2020.01)
*G07C 9/25* (2020.01)
*G07C 9/26* (2020.01)

(52) U.S. Cl.
CPC ..... *G07C 9/257* (2020.01); *G07C 9/29* (2020.01); *G07C 9/26* (2020.01)

(58) Field of Classification Search
USPC ..... 340/5.2, 8.2
See application file for complete search history.

(56) References Cited

U.S. PATENT DOCUMENTS

2006/0246886 A1* 11/2006 Benco ..... G08B 25/08 455/422.1
2007/0186106 A1* 8/2007 Ting ..... H04L 63/0815 713/168
2007/0197261 A1 8/2007 Humbel
2008/0209505 A1* 8/2008 Ghai ..... G06F 21/55 726/1
2010/0209006 A1* 8/2010 Grigsby ..... G06K 9/00 382/218
2011/0291798 A1* 12/2011 Schibuk ..... G07B 15/00 340/5.61
2013/0332727 A1 12/2013 Jaudon et al.
2014/0373111 A1* 12/2014 Moss ..... H04W 12/08 726/5
2016/0358391 A1* 12/2016 Drako ..... H04W 12/08
2016/0379426 A1* 12/2016 Tholen ..... G07C 9/00015 340/5.21

OTHER PUBLICATIONS

Office Action on CN 201780027740.6 dated Jul. 23, 2020, 39 pages with English translation.

* cited by examiner

VIRTUAL PANEL ACCESS CONTROL SYSTEM

CROSS-REFERENCE TO RELATED PATENT APPLICATIONS

This application is a continuation of International Application No. PCT/US2017/023410 filed Mar. 21, 2017, which claims the benefit of and priority to U.S. Provisional Patent Application No. 62/330,850 filed May 3, 2016. The entire disclosure of each of these patent applications is incorporated by reference herein.

BACKGROUND

The present disclosure relates generally to physical access control systems. Access control is the practice of restricting entrance to a property, building, facility, room, zone, or other physical location to authorized persons. Access control can be achieved by restricting entrance through a variety of access control points such as doors, turnstiles, parking gates, elevators, or other physical barriers where granting access can be electronically controlled.

Each access control point typically includes a physical control panel, one or more readers, and one or more access control devices. The physical control panel can be connected to the readers and the access control devices via a hardwired serial connection. The readers can include proximity card readers, biometric readers, keypads, or other input device configured to receive a credential from a user (e.g., by reading an access badge, receiving a PIN, scanning a fingerprint, etc.). The access control devices can include electronic locks, actuators, or other controllable devices that can be operated to automatically grant or deny access through the access control points. For example, a door access control point can include an electronic lock configured to lock and unlock the door in response to a control signal from the physical control panel.

In operation, the physical control panel receives a credential from a reader and sends the credential to a central access control host (e.g., an access control server). The access control host determines whether to grant or deny access by comparing the credential to an access control list. The access control host sends a result of the determination (e.g., grant or deny access) to the physical control panel, which operates the access control devices accordingly. For example, the physical control panel can unlock an electronic lock in response to receiving a control signal from the access control host.

Physical control panels are typically installed at each access control point and can be physically connected to the readers, access control devices, and/or the access control host. Some physical control panels require hardwired data connections (e.g., RS-485 serial communication lines) to communicate with other devices. Additionally, some access control hosts are configured to communicate only with a particular type of physical control panel. It can be difficult to implement an access control point or physical control panel at locations where hardwired communications lines are infeasible or impossible.

SUMMARY

One implementation of the present disclosure is an access control system for a building or campus. The access control system includes an access control host configured to interact with one or more physical control panels to monitor and control physical access to one or more locations of the building or campus. The access control system further includes a mobile device including a virtual panel configured to emulate one or more of the physical control panels to the access control host and perform one or more access control functions of the physical control panels. The virtual panel configures the mobile device to operate as a portable control panel in the access control system.

In some embodiments, the mobile device includes one or more readers configured to obtain a security credential from a user or from a security device possessed by the user. The mobile device may include one or more applications configured to use the security credential to generate a request for the virtual panel to perform one or more of the access control functions.

In some embodiments, the virtual panel is configured to operate as a portable mustering terminal by maintaining a first list of users located within one or more zones of the building or campus, identifying one or more users who have checked-in with the virtual panel at a location outside the building or campus, and moving the identified users from the first list to a second list of users located outside the one or more zones of the building or campus.

In some embodiments, wherein the virtual panel includes a badge database configured to store a set of badge data for each of a plurality of badges. Each set of badge data may indicate whether the corresponding badge is authorized to access one or more locations of the building or campus. The virtual panel may include a rules engine configured to receive a badge authorization request including badge data associated with a badge to be authorized, compare the badge data received as part of the badge authorization request with the badge data stored in the badge database, and grant or deny access one or more locations of the building or campus based on whether the badge data associated with the badge to be authorized matches the badge data stored in the badge database.

In some embodiments, the virtual panel includes a badge database configured to store a set of badge data for each of a plurality of badges. The virtual panel may include a rules engine configured to receive a badge verification request including badge data associated with a badge to be verified, compare the badge data received as part of the badge verification request with the badge data stored in the badge database, and provide a badge verification response indicating whether the badge data received as part of the badge verification request matches the badge data stored in the badge database.

In some embodiments, the virtual panel is configured to determine whether a communication link between the virtual panel and the access control host is active or inactive, operate in an online mode in response to a determination that the communication link is active, and operate in an offline mode in response to a determination that the communication link is inactive. In some embodiments, the virtual panel is configured to log event data generated by the virtual panel in an event database local to the virtual panel while operating in the offline mode and forward the event data logged in the event database to the access control host in response to a determination that the communication link has been restored.

In some embodiments, the virtual panel includes a hardware emulator configured to emulate hardware of the physical control panels and exchange data with the access control host in a hardware-native format native to the hardware of the physical control panels. In some embodiments, the virtual panel includes an extended controller configured to exchange data with the access control host in a format other than a hardware-native format native to the hardware of the physical control panels.

In some embodiments, the virtual panel includes a badge database configured to store badge data for a plurality of badges that the virtual panel is configured to authorize or verify. The hardware emulator may be configured to download badge data from the access control host in the hardware-native format, convert the badge data into a standard format used by one or more other components of the virtual panel, and store the badge data in the badge database in the standard format.

In some embodiments, the virtual panel includes an extended detail synchronization service configured to monitor the badge database for standard badge data that lacks extended badge details, request the extended badge details from the access control host in response to detecting badge data that lacks extended badge details, and store the extended badge details in the badge database along with the standard badge data.

In some embodiments, the extended badge details include one or more types of badge data that cannot be communicated in the hardware-native format. The virtual panel may include an extended controller configured to request the extended badge details from the access control host in a format other than the hardware-native format.

Another implementation of the present disclosure is a virtual panel for an access control system for a building or campus. The virtual panel includes a hardware emulator configured to emulate hardware of one or more physical control panels of the access control system and exchange data with an access control host of the access control system in a hardware-native format native to the hardware of the physical control panels. The virtual panel includes a rules engine configured to perform one or more access control functions of the physical control panels including at least one of a badge authorization function or a badge verification function.

In some embodiments, the virtual panel includes a panel interface configured to receive a request for the virtual panel to perform one or more of the access control functions. The request may include a security credential provided by a user or by a security device possessed by the user.

In some embodiments, the virtual panel is configured to operate as a portable mustering terminal by maintaining a first list of users located within one or more zones of the building or campus, identifying one or more users who have checked-in with the virtual panel at a location outside the building or campus, and moving the identified users from the first list to a second list of users located outside the one or more zones of the building or campus.

In some embodiments, the virtual panel includes a badge database configured to store a set of badge data for each of a plurality of badges. Each set of badge data may indicate whether the corresponding badge is authorized to access one or more locations of the building or campus. The rules engine may be configured to receive a badge authorization request comprising badge data associated with a badge to be authorized, compare the badge data received as part of the badge authorization request with the badge data stored in the badge database, and grant or deny access one or more locations of the building or campus based on whether the badge data associated with the badge to be authorized matches the badge data stored in the badge database.

In some embodiments, the virtual panel includes a badge database configured to store a set of badge data for each of a plurality of badges. The rules engine may be configured to receive a badge verification request comprising badge data associated with a badge to be verified, compare the badge data received as part of the badge verification request with the badge data stored in the badge database, and provide a badge verification response indicating whether the badge data received as part of the badge verification request matches the badge data stored in the badge database.

In some embodiments, the virtual panel includes an event database configured to log event data generated by the virtual panel. The virtual panel may be configured to determine whether a communication link between the virtual panel and the access control host is active or inactive, operate in an offline mode in response to a determination that the communication link is inactive, and operate in an online mode in response to a determination that the communication link is active. Operating in the offline mode may include logging the event data to the event database. Operating in the online mode may include forwarding the event data logged in the event database to the access control host upon restoration of the communication link.

In some embodiments, the virtual panel includes a badge database configured to store badge data for a plurality of badges that the virtual panel is configured to authorize or verify. The hardware emulator may be configured to download badge data from the access control host in the hardware-native format, convert the badge data into a standard format used by one or more other components of the virtual panel, and store the badge data in the badge database in the standard format.

In some embodiments, the virtual panel includes an extended detail synchronization service configured to monitor the badge database for standard badge data that lacks extended badge details. The extended badge details may include one or more types of badge data that cannot be communicated in the hardware-native format. The extended detail synchronization service can be configured to request the extended badge details from the access control host in response to detecting badge data that lacks extended badge details, obtain the extended badge details from the access control host in a format other than the hardware-native format, and store the extended badge details in the badge database along with the standard badge data.

DETAILED DESCRIPTION

Overview

Referring generally to the FIGURES, a virtual panel for an access control system and components thereof are shown according to various exemplary embodiments. The virtual panel can provide all of the features of a physical control panel in an access control system without any of the physical limitations of a hardwired connection between the reader, panel, and access control host. The virtual panel can be used for remote cardholder validation, verification of identity, access control, and numerous mustering applications all on a mobile platform. The virtual panel can be used with any access control system in the same way a physical panel is used. The virtual panel provides an intuitive and easily updatable user interface with plug and play components and software. The virtual panel can be interfaced with multiple different access control systems and can emulate other panels when needed.

The virtual panel is capable of operating in an online mode (e.g., Wi-Fi connected) as well as offline mode (e.g., Wi-Fi disconnected). For example, the virtual panel can maintain a repository (i.e., a local database) of badge information, event information, access control rules, or any other type of data provided by an access control host. If no connection to the access control host is available, the virtual panel can function similarly to its physical counterpart and continue to provide cardholder authentication, verification, authorization, and access control as designed using the information stored in the repository. Once the connection to the access control host is restored, all historical transactions accumulated from the time of connection loss can be forwarded to the access control host and processed. Normal operation continues transparently to the user regardless of whether the virtual panel is connected to the access control host or disconnected.

The virtual panel can provide enhanced security features relative to traditional physical panels. For example, the local repository can be encrypted with a 256-bit AES key that is generated based off of a proprietary fingerprint or signature of the hardware running the virtual panel. This means that the repository is locked per machine and cannot be transferred from machine to machine. All software used by the virtual panel can be signed with an elliptic curve digital signature algorithm (ECDSA) and locked down based on a proprietary signature and hardware IDs. Logs can be fully encrypted with their own 256-bit AES key. Local memory objects can be encrypted when stored and only decrypted once the user physically requests to see an item. When compared to the CK721-A panel or other industry panels, the virtual panel uses a higher level of encryption and better verification of signed software. The virtual panel is also less vulnerable than physical devices since the virtual panel can operate with no wires exposed to the end user.

Access Control Systems

Figure 1:
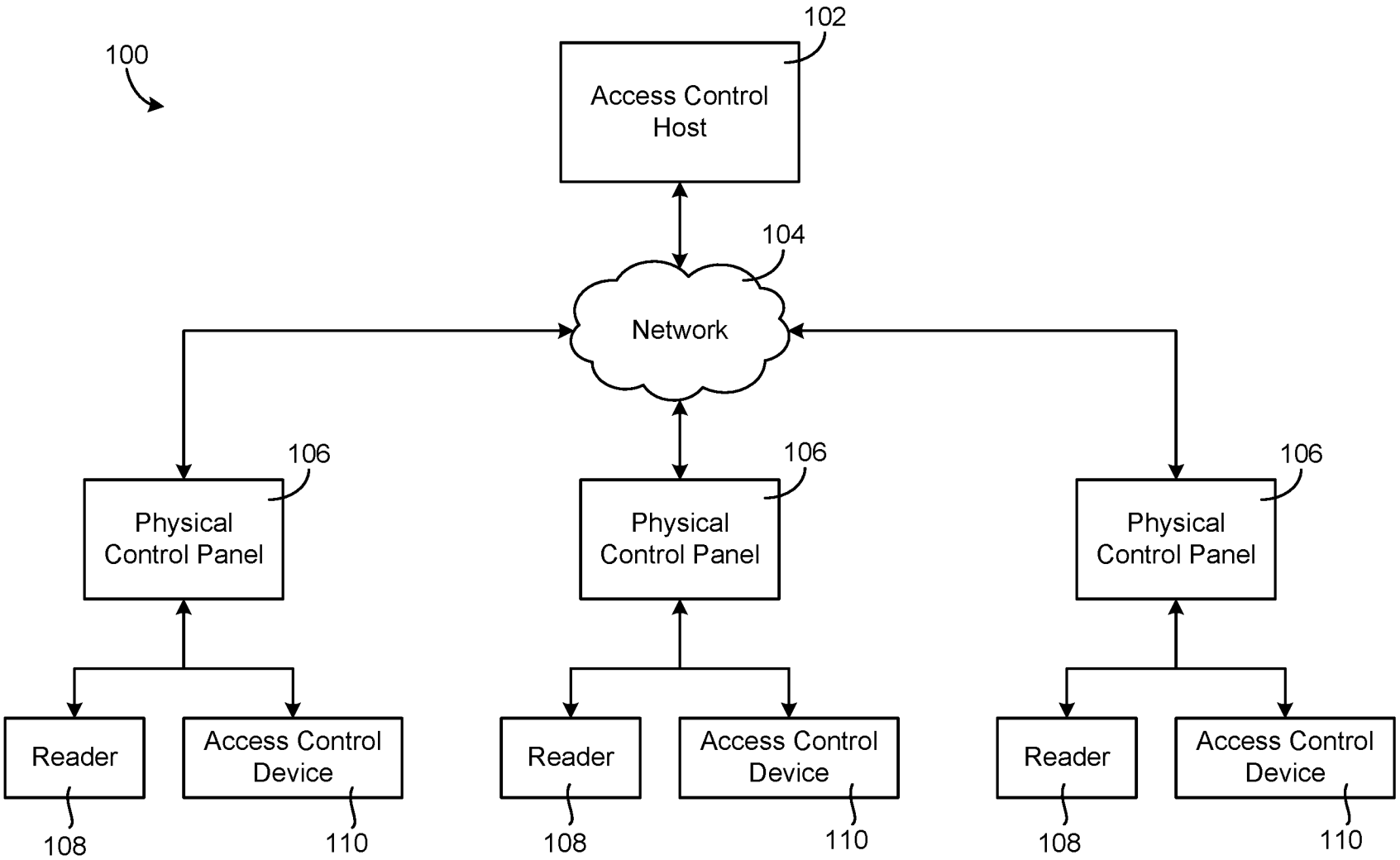
FIG. 1 is a block diagram of a conventional access control system, according to some embodiments.

Referring now to FIG. 1, a block diagram of a conventional access control system 100 is shown, according to some embodiments. Access control system 100 is configured to monitor and control access to various locations in or around a building (e.g., rooms or zones in a building, parking structures, etc.) using a collection of access control points. Each access control point is shown to include a physical control panel 106, a reader 108, and an access control device 110. Physical control panes 106 can be connected to readers 108 and access control devices 110 via a hardwired serial connection (e.g., RS-485 serial communication lines).

Readers 108 can include proximity card readers, biometric readers, keypads, or other input device configured to receive a credential from a user (e.g., by reading an access badge, receiving a PIN, scanning a fingerprint, etc.). Readers 108 can receive input from a user or a security device possessed by the user. For example, readers 108 can be configured to read a smartcard (e.g., in integrated circuit card) possessed by a user to automatically obtain a smartcard ID from the smart card. As another example, readers 108 can be configured receive an access code via a keypad or receive an electronic security token via wireless communications (e.g., NFC, Bluetooth, etc.) with a nearby user device (e.g., a smartphone, a tablet, etc.).

Access control devices 110 can include electronic locks, actuators, or other controllable devices that can be operated to automatically grant or deny access through the access control points. For example, a door access control point can include an electronic lock configured to lock and unlock the door in response to a control signal from the physical control panel. In some embodiments, access control devices 110 are distributed throughout a building or campus (i.e., a group of buildings). Each access control device 110 can be configured to control a particular access point (e.g., a doorway, a parking structure, a building entrance or exit, etc.).

User interactions with readers 108 (i.e., access requests) can be recorded as events and sent to access control host 102 via a communications network 104 (e.g., a TCP/IP network, a building automation and control network, a LAN, a WAN, etc.). Each event may include, for example, a timestamp, a device ID identifying the access control device 110, a security credential provided by the user at the access point (e.g., a smartcard ID, an access code, etc.), a user ID, and/or any other information describing the access request. Access control host 102 can process the events and determine whether to allow or deny the access request. In some embodiments, access control host 102 accesses a security database to determine whether the security credential provided by the user matches a stored security credential. In some embodiments, access control host 102 determines whether the user associated with the access request (e.g., defined by the user ID or smartcard ID) is authorized to access the area controlled by the access control device 110. In some embodiments, access control host 102 displays an alarm or prompt for a security workstation (e.g., a computer operated by security personnel) to allow or deny the access request.

In some embodiments, physical control panels 106 require hardwired data connections to communicate with readers 108, access control devices 110, and/or access control host 102. Accordingly, it can be difficult to implement an access control point or physical control panel 106 at locations where hardwired communications lines are infeasible or impossible. Additionally, access control host 102 can be configured to communicate only with a particular type of physical control panel 106. For example, access control host 102 can be configured to allow integration solely at the access control host level via an API or SDK, which typically does not allow other devices to integrate with access control host 102 for authentication. Accordingly, it can be difficult to replace physical control panels 106 with other devices.

Figure 2:
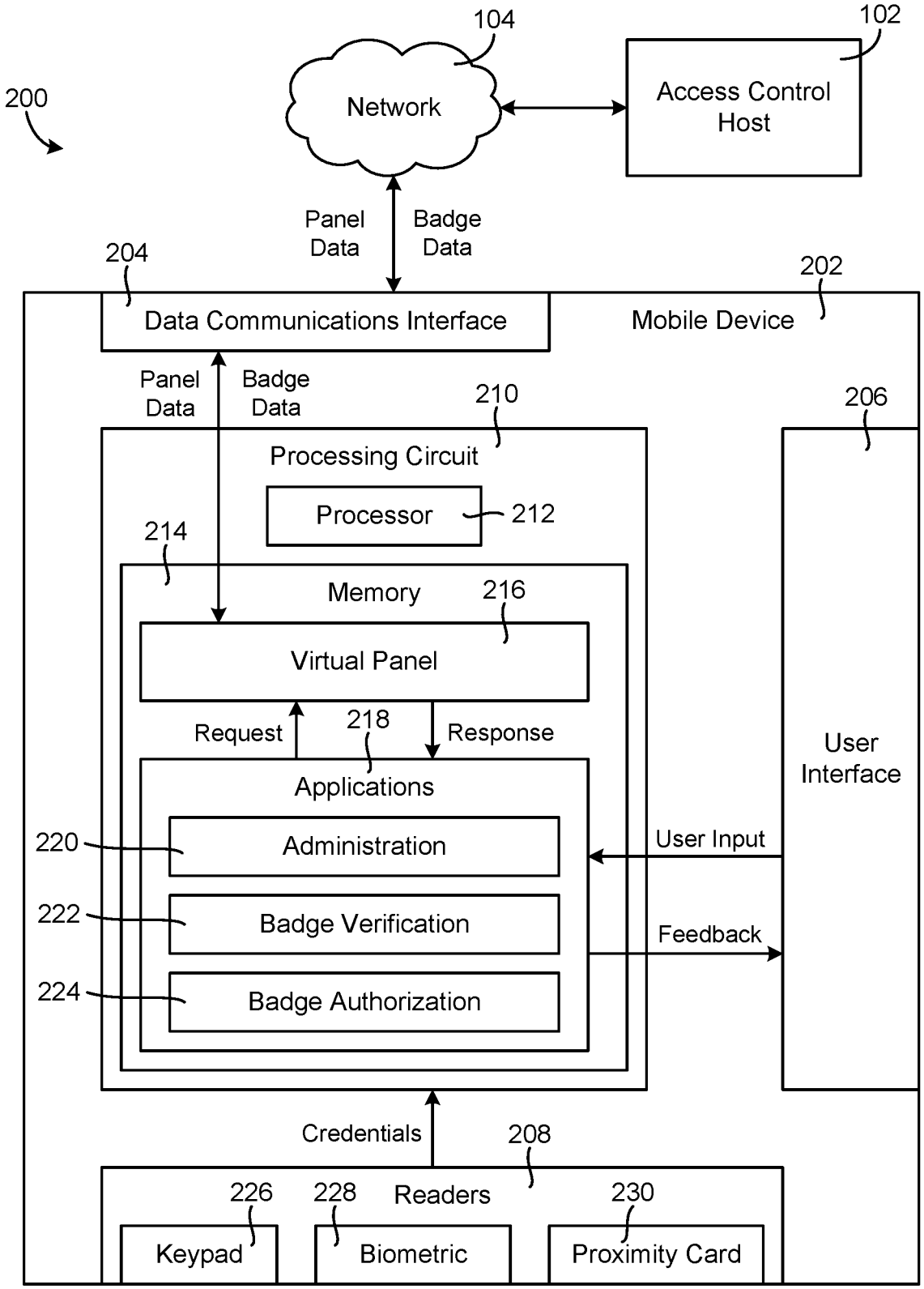
FIG. 2 is block diagram of another access control system with a virtual panel, according to some embodiments.

Referring now to FIG. 2, a block diagram of another access control system 200 is shown, according to some embodiments. Access control system 200 can include some or all of the same components as access control system 100. For example, access control system 200 is shown to include access control host 102 and communications network 104. Access control system 200 is also shown to include a mobile device 202. Mobile device 202 can be configured to supplement or replace physical control panels 106, readers 108, and access control devices 110. Mobile device 202 can emulate physical control panels 106 to provide compatibility with existing access control hosts 102 configured to support only a particular type of physical control panel 106. In some embodiments, the emulation is provided by virtual panel 216.

Virtual panel 216 can emulate physical control panels 106 to access control host 102 to enable mobile device 202 to function as a portable control panel. In some embodiments, virtual panel 216 can emulate multiple different physical control panels to facilitate integration with multiple different access control systems. Virtual panel 216 can also emulate multiple different control panels in the same access control system (e.g., control panels at different access points, control panels for different zones, etc.). Virtual panel 216 provides mobile device 202 with the capability to verify user credentials, validate or authorize access, and muster at any location without requiring hardwired communications lines. Additionally, virtual panel 216 can operate in both an online mode (i.e., when mobile device 202 is connected to access control host 102) and an offline mode (e.g., when mobile device 202 is not connected to access control host 102).

Although virtual panel 216 is shown as a component of mobile device 202, it should be understood that virtual panel 216 can be implemented as part of any system or device (e.g., mobile devices, non-mobile devices, hardwired control panels, wireless control panels, etc.). Virtual panel 216 can run as software on any hardware platform and can integrate with any access control system. For example, virtual panel 216 can run on hardware such as the Microsoft Surface, Windows Desktop, Android devices, iOS devices, etc. Virtual panel 216 can integrate with the P2000 access control system by Johnson Controls or any other type of access control system. Virtual panel 216 is described in greater detail with reference to FIGS. 3-7.

Still referring to FIG. 2, mobile device 202 is shown to include a user interface 206 and several readers 208. User interface 206 can include any of a variety of user input devices and/or user output devices. For example, user interface 206 can include an electronic display, a touch sensitive display, a keyboard, a mouse, a touchpad, speakers, tactile feedback devices, switches, dials, buttons, or any other device configured to receive input from a user or provide output to a user. Readers 208 are shown to include a card reader 230 (e.g., an IC card reader), a biometric reader 228, and a keypad 226. Mobile device 202 can use readers 208 to receive input from a user or from a security device possessed by the user. For example, card reader 230 can be configured to read a proximity card possessed by a user and automatically obtain a card ID from the proximity card. Biometric reader 228 can be configured to read a fingerprint, voice print, or other biometric marker. Keypad 226 can be configured to receive an access code or other security credential from a user.

Mobile device 202 is shown to include a data communications interface 204 and a processing circuit 210. Communications interface 204 can include wired or wireless interfaces (e.g., jacks, antennas, transmitters, receivers, transceivers, wire terminals, etc.) for conducting data communications with various systems, devices, or networks. For example, communications interface 204 can include an Ethernet card and port for sending and receiving data via an Ethernet-based communications network. As another example, communications interface 204 can include a WiFi transceiver for communicating via a wireless communications network. Communications interface 204 can be configured to communicate via local area networks (e.g., a building LAN), wide area networks (e.g., the Internet, a cellular network, etc.), and/or conduct direct communications (e.g., NFC, Bluetooth, etc.). In various embodiments, communications interface 204 can be configured to conduct wired and/or wireless communications. For example, communications interface 204 can include one or more wireless transceivers (e.g., a Wi-Fi transceiver, a Bluetooth transceiver, a NFC transceiver, a cellular transceiver, etc.) for communicating with access control host 102 via communications network 104.

Processing circuit 210 is shown to include a processor 212 and memory 214. Processor 212 can be a general purpose or specific purpose processor, an application specific integrated circuit (ASIC), one or more field programmable gate arrays (FPGAs), a group of processing components, or other suitable processing components. Processor 212 is configured to execute computer code or instructions stored in memory 214 or received from other computer readable media (e.g., CDROM, network storage, a remote server, etc.).

Memory 214 can include one or more devices (e.g., memory units, memory devices, storage devices, etc.) for storing data and/or computer code for completing and/or facilitating the various processes described in the present disclosure. Memory 204 can include random access memory (RAM), read-only memory (ROM), hard drive storage, temporary storage, non-volatile memory, flash memory, optical memory, or any other suitable memory for storing software objects and/or computer instructions. Memory 214 can include database components, object code components, script components, or any other type of information structure for supporting the various activities and information structures described in the present disclosure. Memory 214 can be communicably connected to processor 212 via processing circuit 210 and may include computer code for executing (e.g., by processor 212) one or more processes described herein. When processor 212 executes instructions stored in memory 214, processor 212 generally configures mobile device 202 (and more particularly processing circuit 210) to complete such activities.

Still referring to FIG. 2, memory 214 is shown to include several applications 218 including an administration application 220, a badge verification application 222, and a badge authorization application 224. In some embodiments, applications 218 include a mustering application. In some embodiments, applications 218 are separate applications running on mobile device 202. In other embodiments, applications 218 are parts of a single application configured to perform administration functions, badge verification functions, badge authorization, and/or mustering functions.

Applications 218 can receive user input and provide feedback to a user via user interface 206. Applications 218 can also receive credentials via readers 208. Applications 218 can interact with virtual panel 216 to perform administration functions, badge verification functions, badge validation (i.e., authorization) functions, and/or mustering functions (described in greater detail with reference to FIGS. 6-7).

Virtual panel 216 can provide all of the features of a physical control panel in an access control system. In various embodiments, virtual panel 216 can emulate the CK721-A control panel by Johnson Controls or any other physical control panel. Virtual panel 216 is capable of operating in an online mode (e.g., Wi-Fi connected) as well as offline mode (e.g., Wi-Fi disconnected). For example, virtual panel 216 can maintain a repository (i.e., a local database) of badge information, event information, access control rules, or any other type of data provided by access control host 102. If no connection to access control host 102 is available, virtual panel 216 can function similarly to its physical counterpart and continue to provide cardholder authentication, verification, authorization, and access control as designed using the information stored in the repository. Once the connection to access control host 102 is restored, all historical transactions accumulated from the time of connection loss can be forwarded to access control host 102 and processed. Normal operation continues transparently to the user regardless of whether virtual panel 216 is connected to access control host 102 or disconnected.

Virtual panel 216 can provide enhanced security features relative to traditional physical panels. For example, the local repository can be encrypted with a 256-bit AES key that is generated based off of a proprietary fingerprint or signature of the hardware running virtual panel 216. This means that the repository is locked per machine and cannot be transferred from machine to machine. All software within virtual panel 216 and/or applications 218 can be signed with an elliptic curve digital signature algorithm (ECDSA) and locked down based on a proprietary signature and hardware IDs. Logs can be fully encrypted with their own 256-bit AES key. Local memory objects can be encrypted when stored and only decrypted once the user physically requests to see an item. When compared to the CK721-A panel or other industry panels, virtual panel 216 uses a higher level of encryption and better verification of signed software. Virtual panel 216 is also less vulnerable than physical devices since virtual panel 216 can operate with no wires exposed to the end user.

Virtual Panel

Figure 3:
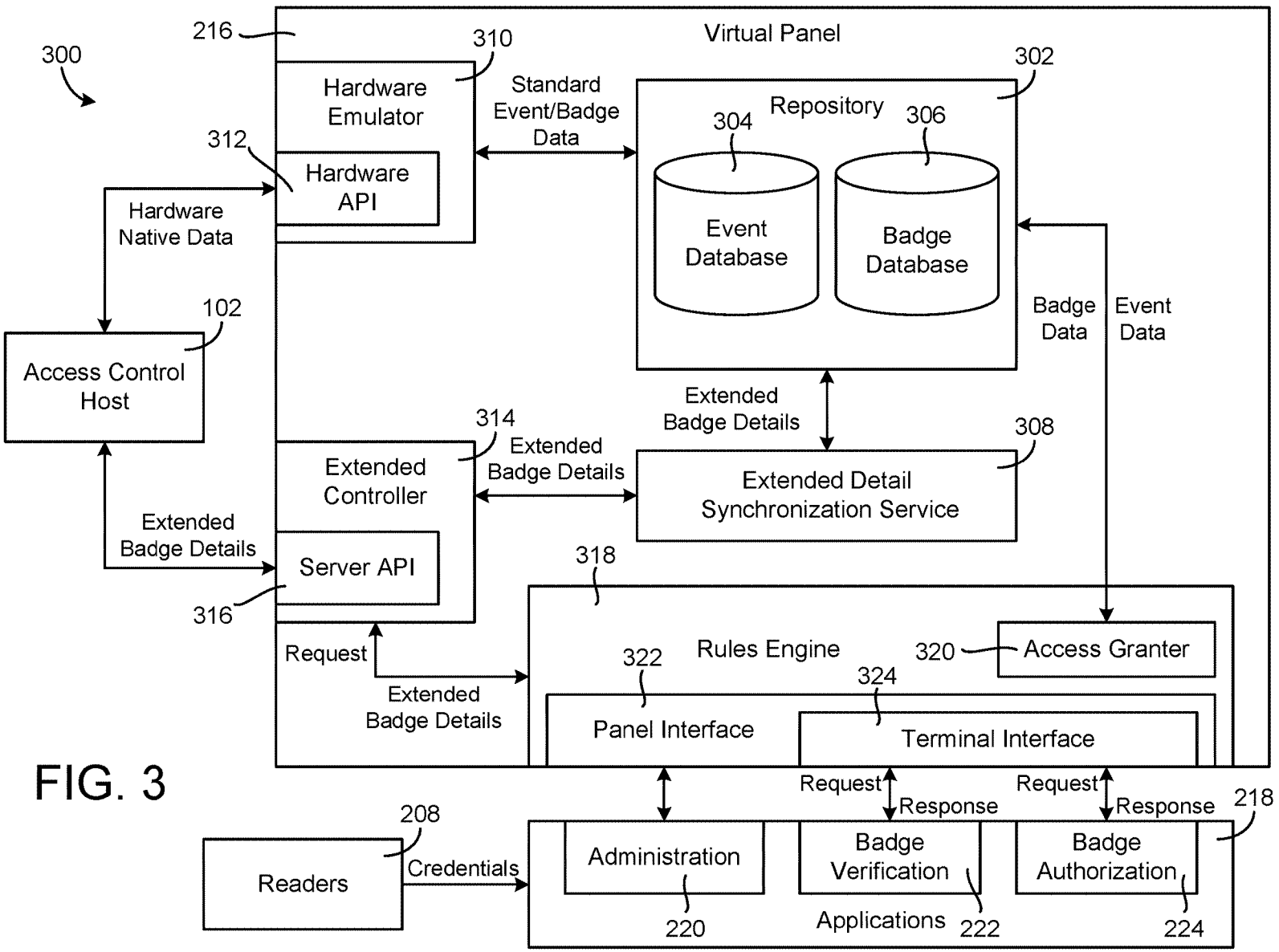
FIG. 3 is a block diagram illustrating the virtual panel of FIG. 2 in greater detail, according to some embodiments.

Referring now to FIG. 3, a block diagram 300 illustrating virtual panel 216 in greater detail is shown, according to some embodiments. Virtual panel 216 is shown to include a repository 312 including an event database 304 and a badge database 306. Event database 304 is configured to store events logged by virtual panel 216. Logged events can include, for example, access request events, badge authorization or verification events, badge authorization or verification results, mustering events, security events, or any other event logged by virtual panel 216. Badge authorization or verification events can be received from applications 218 (e.g., via terminal interface 324) as requests for badge verification and/or badge authorization. Such events can include timestamps, access control device IDs, security credentials, user IDs, or any other information describing the events.

Badge database 306 is configured to store badge data for various badges that can be authorized or verified by virtual panel 216. Badge data can include, for example, a badge ID, security credential, user ID, access groups, badge permissions, access rights, expiration times, and/or other information associated with a badge. The badge data stored in badge database 306 can include standard badge data and extended badge details. The standard badge data can include any type of badge data that can be communicated to the physical panel emulated by virtual panel 216 (i.e., via hardware API 312). Standard badge data can be received from access control host 102 using a communications protocol or messaging format native to the physical panel hardware emulated by virtual panel 216. For example, access control host 102 can provide virtual panel 216 with hardware native data. The hardware native data can be processed by hardware emulator 310 to convert the hardware native data to standard badge data.

Extended badge details can include various types of badge data that cannot be communicated as hardware native data. For example, extended badge details can include a cardholder image, user defined fields, user notes, and/or other non-standard types of badge information. In some embodiments, extended badge details include badge information that cannot be communicated to the physical panel emulated by virtual panel 216. Extended badge details can be received from access control host 102 via an extended controller 314 running a server API 316.

In some embodiments, virtual panel 216 includes an extended detail synchronization service 308 that monitors repository 302 for events requiring extended detail synchronization. Such events can include, for example, new badge data, changed badge data, expired badge data, or other changes to the badge data stored in badge database 306. Extended detail synchronization service 308 can request extended badge details from access control host 102 via extended controller 314 and server API 316. Access control host 102 can provide extended badge details to virtual panel 314 via extended controller 314 and server API 316. The extended badge details can be stored in badge database 306 and/or provided to rules engine 318 (e.g., in response to a badge verification request).

Rules engine 318 can process badge authorization or verification requests using information stored in badge database 306 and/or information received from access control host 102. For example, rules engine 318 is shown to include an access granter 320. Access granter 320 can compare a credential received as part of a badge authorization request with badge data stored in badge database 306. If the stored badge data indicates that the badge is authorized, access granter 320 can grant access (e.g., by providing a response to badge authorization application 224) and store the result as event data in event database 304. Similarly, rules engine 318 can compare a badge ID or other information received as part of a badge verification request with stored badge data to verify the badge information. If the badge data received as part of the request matches the stored badge data, rules engine 318 can provide a response to badge verification application 22 and store the result as event data in event database 304.

Virtual panel 216 can operate in an online mode or an offline mode. In the online mode, virtual panel 216 is connected to access control host 102 and can receive badge data from access control host 102. Virtual panel 216 can also forward logged events to access control host 102 when operating in the online mode. In the offline mode, virtual panel 216 can continue to verify and authorize badges using the badge data stored in badge database 306. This feature allows virtual panel 316 to continue normal operation regardless of whether virtual panel 216 is connected to access control host 102 or disconnected. Event data can be stored in event database 304 while operating in the offline mode and forwarded to access control host 102 when the connection is restored.

Figure 4:
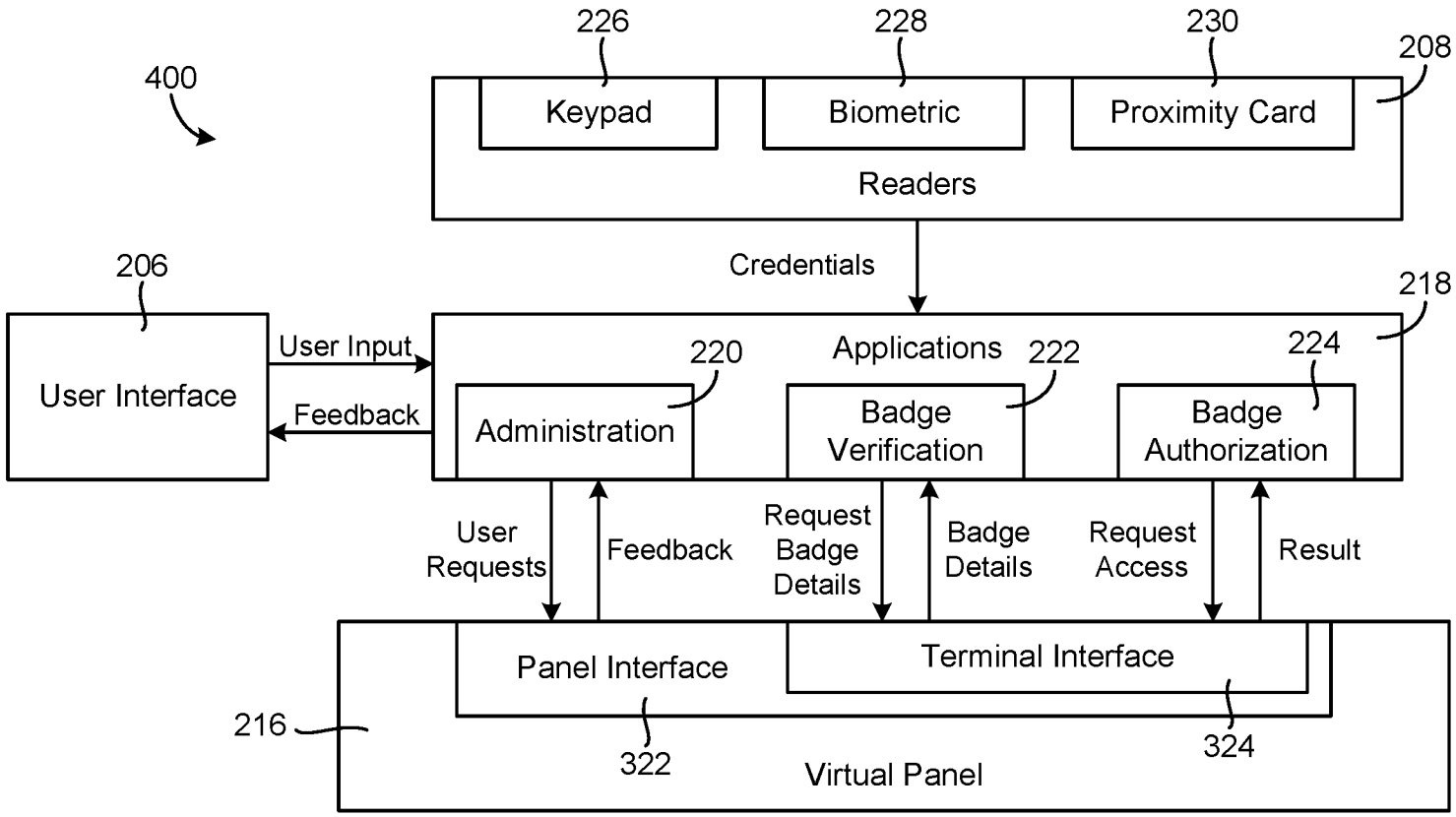
FIG. 4 is a block diagram illustrating a portion of the access control system of FIG. 2 in greater detail, according to some embodiments.

Referring now to FIG. 4, a block diagram 400 illustrating a portion of access control system 200 in greater detail is shown, according to some embodiments. As shown in diagram 400, readers 208 provide applications 218 with credentials. Credentials can include, for example, a PIN code or password received via keypad 228, a biometric marker obtained via biometric reader 228, a card ID or badge ID received via proximity card reader 230, or any other type of credential that can be provided by a user or a user device.

Applications 218 use the credentials to generate various types of requests for virtual panel 216. For example, badge authorization application 224 can generate a badge authorization request (e.g., a request for access) that includes the credential. Similarly, badge verification application 222 can generate a badge verification request (e.g., a request for badge details) that includes the credential. Such requests can be provided to virtual panel 216 via terminal interface 324. Administration application 220 can receive user input from user interface 206 (e.g., user requests) and provide the user input to virtual panel 216 via panel interface 322.

Virtual panel 216 can process the requests using rules engine 318 (as described with reference to FIGS. 6-7) and provide appropriate responses to applications 218. For example, virtual panel 216 can provide a badge authorization result to badge authorization application 224 in response to a badge authorization request. Virtual panel 216 can provide badge details to badge verification application 222 in response to a request for badge details. Virtual panel 216 can provide feedback to administration application 220 in response to a user request. The feedback can be presented to a user via user interface 206. Feedback provided via user interface 206 can also include badge details and/or badge authorization results.

Virtual Panel Processes

Figure 5:
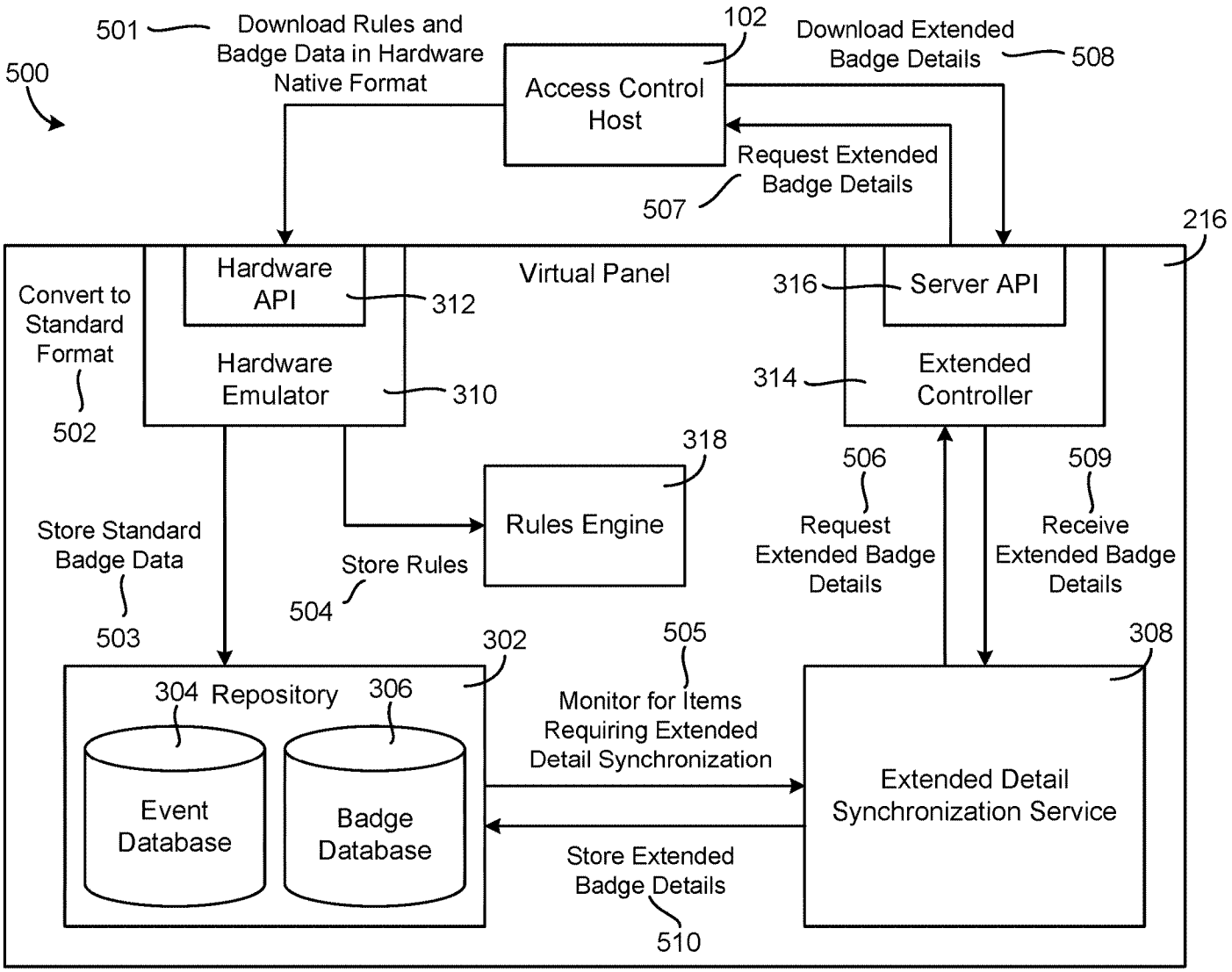
FIG. 5 is a block diagram illustrating a badge details synchronization process that can be performed by the virtual panel of FIG. 2, according to some embodiments.

Referring now to FIG. 5, a block diagram 500 illustrating a badge details synchronization process that can be used by virtual panel 216 is shown, according to some embodiments. Virtual panel 216 can communicate with access control host 102 via both hardware emulator 310 (using hardware API 312) and extended controller 314 (using server API 316). Virtual panel 216 can use hardware emulator 310 and hardware API 312 to download rules and badge data from access control host 102 in a hardware native format (step 501). The hardware native format can include a communications protocol or messaging format used by the physical panel emulated by hardware emulator 310. This facilitates the hardware emulation by allowing virtual panel 216 to communicate with access control host 102 in the same way as the emulated physical panel. Access control host 102 does not require any modification to communicate with virtual panel 216 via hardware API 312 since the messaging format is native to access control host 102 and/or the emulated physical panel.

Hardware emulator 310 can convert the data received in the hardware native format to a standard format (step 502). The standard format can be an object-based data format or container format in which the rules and badge data are stored or used by virtual panel 216. In some embodiments, virtual panel 216 includes multiple hardware emulators 310. Each hardware emulator 310 can be configured to emulate a different physical panel and can communicate with different types of access control hosts. Each hardware emulator 310 can use a communications protocol or messaging format native to a different physical panel and/or access control host to enable virtual panel 216 to be used in multiple different access control systems. The converted standard badge data can be stored in repository 306 (step 503), whereas the converted rules can be provided to rules engine 318 (step 504).

Extended detail synchronization service 308 can monitor repository 302 for items requiring extended detail synchronization (step 505). Such events can include, for example, new badge data, changed badge data, expired badge data, or other changes to the badge data stored in badge database 306. Extended detail synchronization service 308 can request extended badge details from extended controller 314 (step 506), which can forward the request for extended badge details to access control host 102 via server API 316 (step 507). Access control host 102 can provide the requested extended badge details to virtual panel 314 via extended controller 314 and server API 316 (step 508). Extended detail synchronization service 308 can receive the extended badge details from extended controller 314 (step 509) and store the extended badge details in badge database 306 (step 510).

Figure 6:
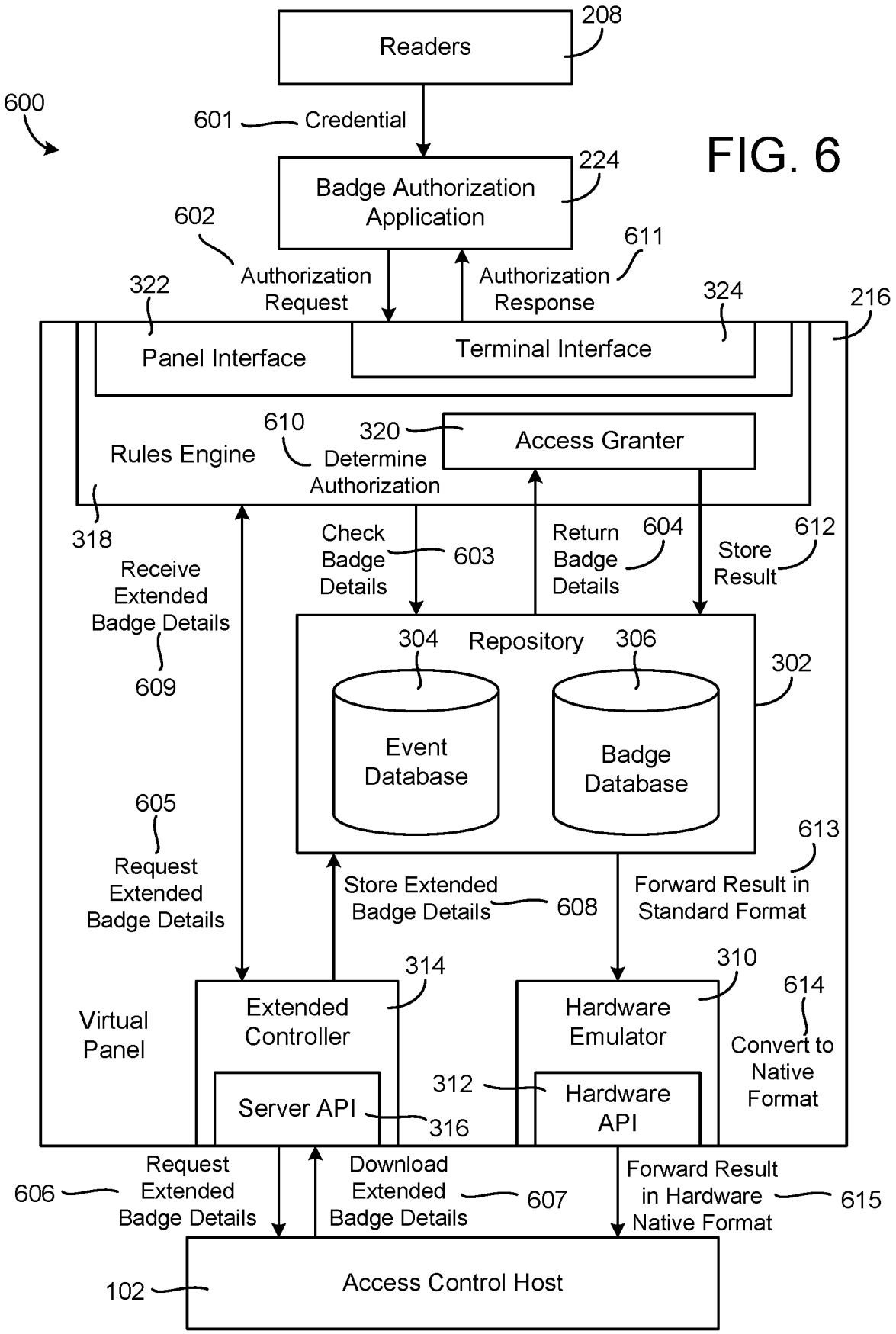
FIG. 6 is a block diagram illustrating a badge authorization process which can be performed by the virtual panel of FIG. 2, according to some embodiments.

Referring now to FIG. 6, a block diagram 600 illustrating a badge authorization process which can be performed by virtual panel 216 is shown, according to some embodiments. Readers 208 can provide a credential 601 to badge authorization application 224 (step 601). Badge authorization application 224 can use the credential to generate a badge authorization request and can provide the badge authorization request to virtual panel 216 via terminal interface 324 (step 602). In some embodiments, the badge authorization request includes a badge ID or other attribute of the badge or user for which authorization is requested.

Rules engine 318 receives the badge authorization request and checks badge database 306 for badge details associated with the authorization request (step 603). In some embodiments, the badge details include access rights, permissions, or other authorization information associated with the badge. In some embodiments, the badge details include extended badge details such as user image, user-defined fields, or other non-standard badge information. If the badge details are found in badge database 306, the badge details can be provided to access granter 320 (step 604). However, if the badge details are not found in badge database 306, rules engine 318 can request the badge details from extended controller 314 and/or hardware emulator 310 (step 605). In some embodiments, rules engine 318 requests extended badge details from extended controller 314 and standard badge details 310 from hardware emulator 310.

Extended controller 314 can request the extended badge details from access control host 102 via server API 316 (step 606). Similarly, hardware emulator 310 can request the standard badge details from access control host 102 via hardware API 312. Access control host 102 can provide the requested badge details to virtual panel 314 via extended controller 314 and/or hardware emulator 310 (step 607). Extended controller 314 can store the extended badge details in badge database 306 (step 608) and provide the extended badge details to rules engine 318 (step 609). Similarly, hardware emulator 310 can store the standard badge details in badge database 306 and provide the standard badge details to rules engine 318.

Access granter 320 can use the badge details to determine whether to grant or deny authorization (step 610). Access granter 320 can generate an authorization response and provide the authorization response to badge authorization application 224 (step 611). The authorization response can indicate whether access is granted or denied by access granter 320 in step 610. Access granter 320 can also store the result of the authorization determination as event data in event database 304 (step 612).

Hardware emulator 310 can receive the authorization result in a standard format (step 613) and convert the authorization result to a native format used by the emulated physical panel (step 614). Step 614 can include generating a message containing the authorization result and formatting the message according to a communications protocol or messaging format used by the emulated physical panel. This allows virtual panel 216 to provide the authorization result to access control host 102 in a hardware native format (step 615).

Figure 7:
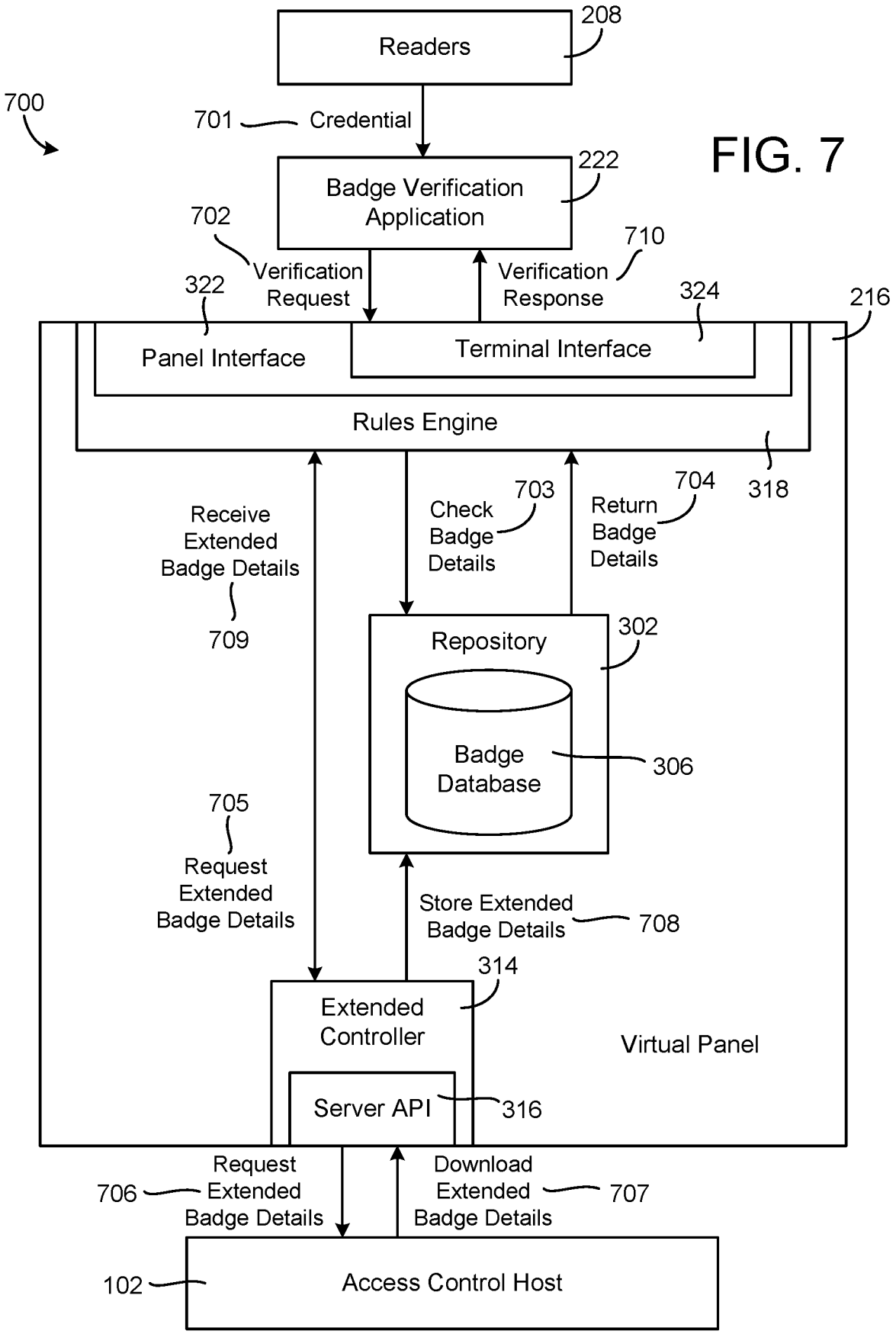
FIG. 7 is a block diagram illustrating a badge verification process which can be performed by the virtual panel of FIG. 2, according to some embodiments.

Referring now to FIG. 7, a block diagram 700 illustrating a badge verification process which can be performed by virtual panel 216 is shown, according to some embodiments. Readers 208 can provide a credential 601 to badge verification application 222 (step 701). Badge verification application 222 can use the credential to generate a badge verification request and can provide the badge verification request to virtual panel 216 via terminal interface 324 (step 702). In some embodiments, the badge verification request includes a badge ID or other attribute of the badge or user for which verification is requested.

Rules engine 318 receives the badge verification request and checks badge database 306 for badge details associated with the verification request (step 703). In some embodiments, rules engine 318 ignores authorization rules or badge filtering when processing the badge verification request. In some embodiments, the badge details include extended badge details such as user image, user-defined fields, or other non-standard badge information. If the badge details are found in badge database 306, the badge details can be provided to rules engine 318 (step 704). However, if the badge details are not found in badge database 306, rules engine 318 can request the badge details from extended controller 314 (step 705).

Extended controller 314 can request the extended badge details from access control host 102 via server API 316 (step 706). Access control host 102 can provide the requested badge details to virtual panel 314 via extended controller 314 (step 707). Extended controller 314 can store the extended badge details in badge database 306 (step 708) and provide the extended badge details to rules engine 318 (step 709).

Rules engine 318 can use the badge details to generate a verification response and provide the verification response to badge verification application 224 (step 710). The verification response can include the extended badge details received from badge database 306 and/or access control host 102. In some embodiments, the verification response indicates whether the badge information provided as part of the verification request matches the badge data stored in badge database 106 and/or received from access control host 102. In some embodiments, rules engine 318 stores a result of the badge verification as event data in event database 304 and/or provides the result to access control host 102 via extended controller 314.

User Interfaces

Figure 8:
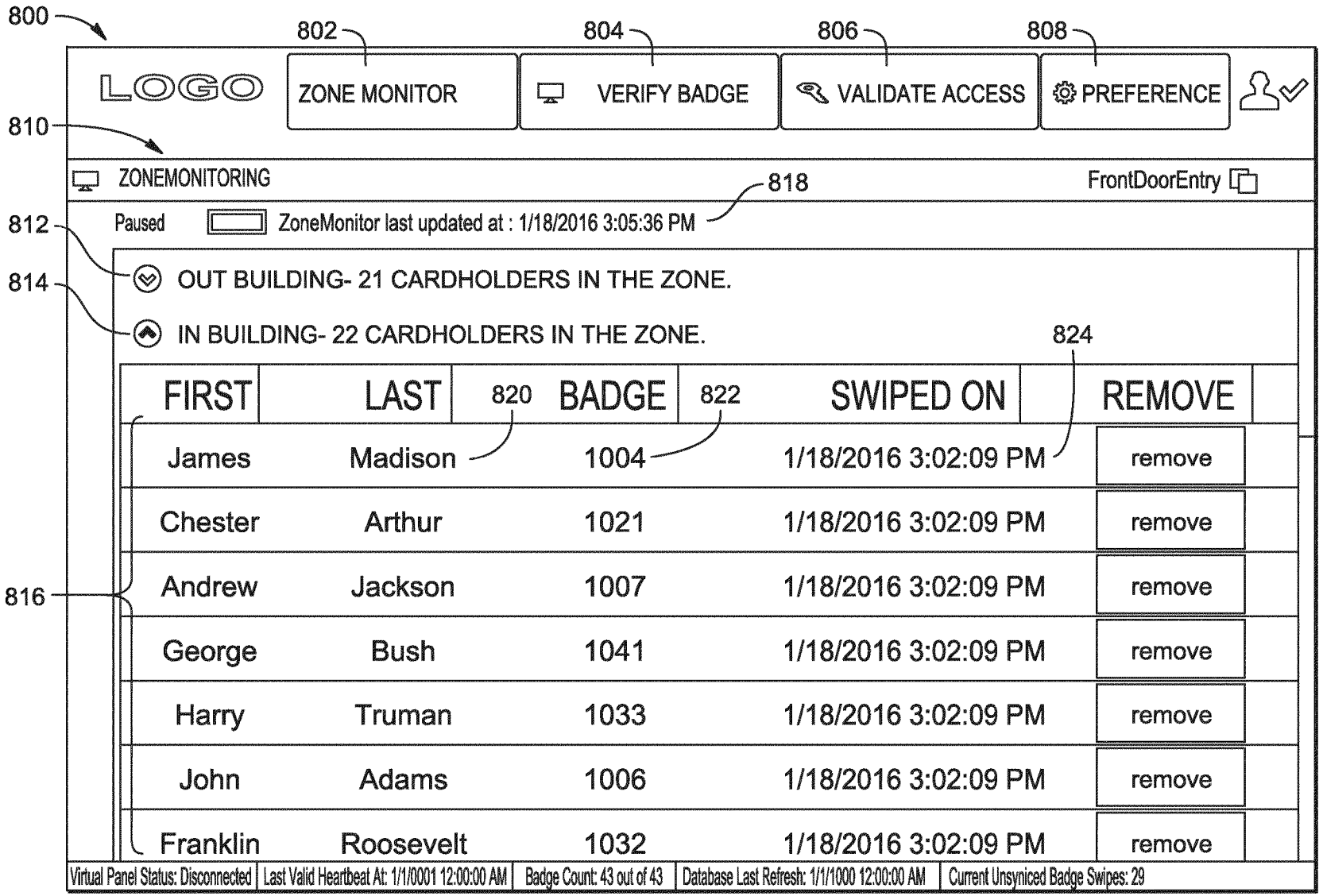
FIG. 8 is a drawing of a mustering interface which can be generated by the virtual panel of FIG. 2 and/or an application running on a mobile device, according to some embodiments.

Referring now to FIG. 8, a user interface 800 which can be generated by virtual panel 216 and/or applications 218 is shown, according to some embodiments. User interface 800 is shown to include a zone monitor tab 802, a verify badge tab 804, a validate access tab 806, and a preference tab 808. In FIG. 8, zone monitor tab 802 is selected. Selecting zone monitor tab 802 can trigger a mustering application to interact with virtual panel 216 to perform mustering-related functions and may cause a mustering interface 810 to be displayed. For example, virtual panel 216 can be operated as a mustering terminal to allow users to check-in at the location of virtual panel 216. Since virtual panel 216 can be run by a mobile device, the mustering terminal can be portable to allow mustering at any location (e.g., in the event of a building evacuation).

Mustering interface 810 is shown to include a listing of various zones 812-814 and an indication of which cardholders are located in each zone (e.g., a list 816). Advantageously, zones 812-814 are not limited to physically controlled building zones, but can also include outside zones. For example, mustering interface 810 is shown to include an "out building" zone 812 which represents a zone outside the building and an "in building" zone 814 which represents a zone inside the building. Mustering interface 810 indicates that 21 cardholders are located in "out building" zone 812, whereas 22 cardholders are located in "in building" zone 814. Cardholders can check-in to a particular zone via virtual panel 216 (e.g., by scanning a badge, by entering a user credential, etc.). Each cardholder can be identified in list 816 by name 820 and/or badge number 822. List 816 may indicate a time 824 at which each cardholder checked into zone in which the cardholder is located. In some embodiments, the list 816 of cardholders in each zone is updated in real-time. This feature allows emergency personnel to determine whether the building has been completely evacuated in the event of an emergency or drill. Mustering interface 810 can indicate a time 818 at which list 816 was last updated to provide assurance that the mustering information is accurate.

Figure 9:
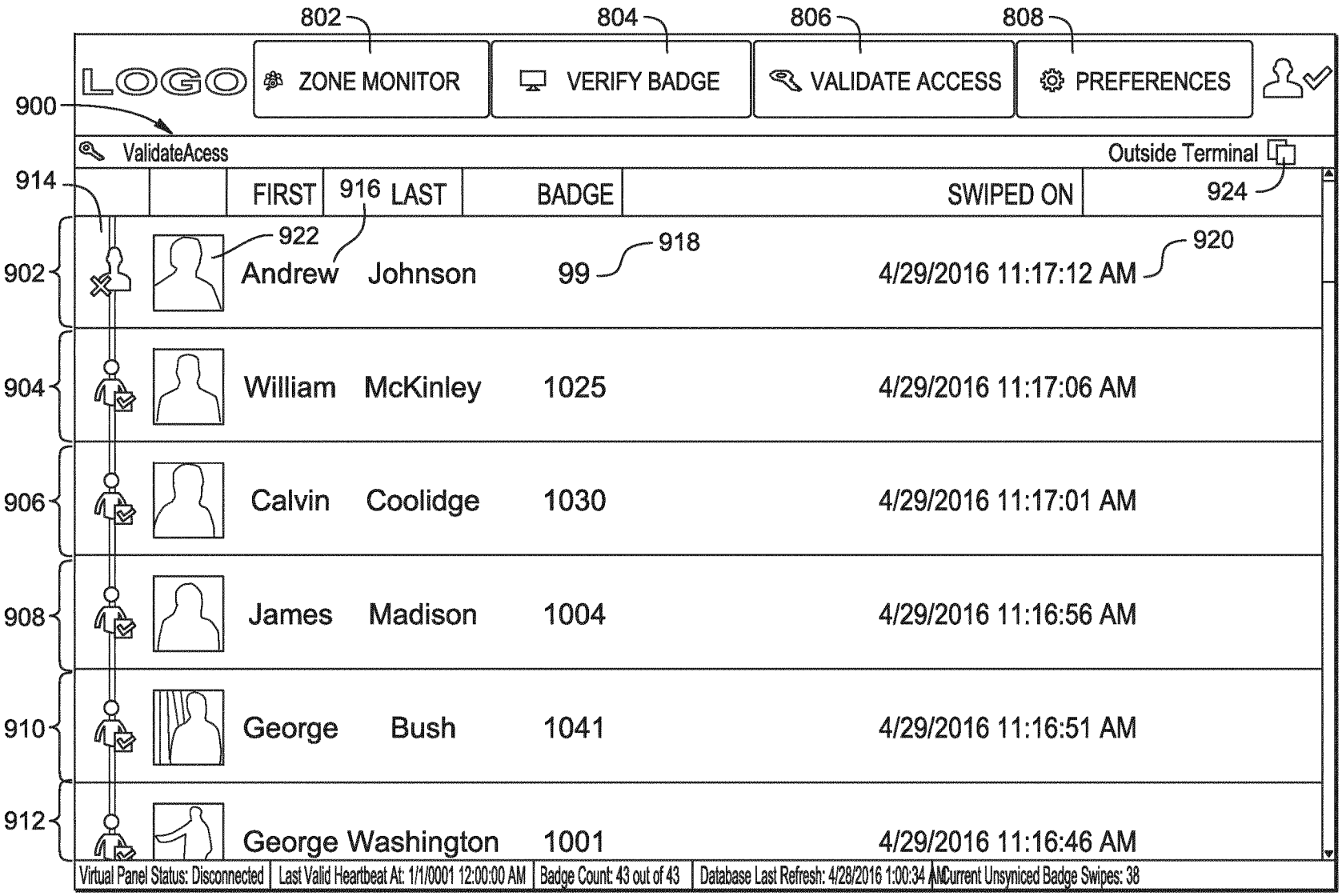
FIG. 9 is a drawing of a validate access interface which can be generated by the virtual panel of FIG. 2 and/or an application running on a mobile device, according to some embodiments.

Referring now to FIG. 9, another user interface 900 which can be generated by virtual panel 216 and/or applications 218 is shown, according to some embodiments. User interface 900 can be displayed in response to selecting validate access tab 806. Selecting validate access tab 806 can trigger the badge authorization application to interact with virtual panel 216 to perform authorization-related functions. For example, virtual panel 216 can be operated as a mobile checkpoint by a security guard while on guard tour. Virtual panel 216 can be used at airports within terminals, baggage handling areas, and/or on the airport tarmac to check IDs at locations where no physical hardwired or wireless hardware exists. Virtual panel 216 can also be used at mines or isolated work sites for group and bulk authentication (e.g., bussing in employees or contractors through main gates). Virtual panel 216 can be used by universities or government facilities to quickly validate visitor badges. Virtual panel 216 can be used by hospitals for employee/staff management and facility wide access control where privacy policies limit how and where access control can be located. Law enforcement can use virtual panel 216 for access to patients which are in custody while at the hospital.

Validate access interface 900 is shown to include a listing of previous authorization events 902, 904, 906, 908, 910, 912 and the result 914 associated with each. Attributes of authorization events 902-912 can include, for example, the name 916 of the user associated with the authorization request, the badge number 918 of the user associated with the authorization request, the time 920 at which the badge swipe occurred, an image 922 of the user, and/or a result 914 of the authorization event (e.g., grant, deny, etc.). Validate access interface 900 can include a terminal selection icon 924 which can be selected to change the identity of the validation terminal. This allows a single mobile device and/or virtual panel 216 to emulate multiple physical terminals to validate access for multiple different locations and/or zones.

Figure 10:
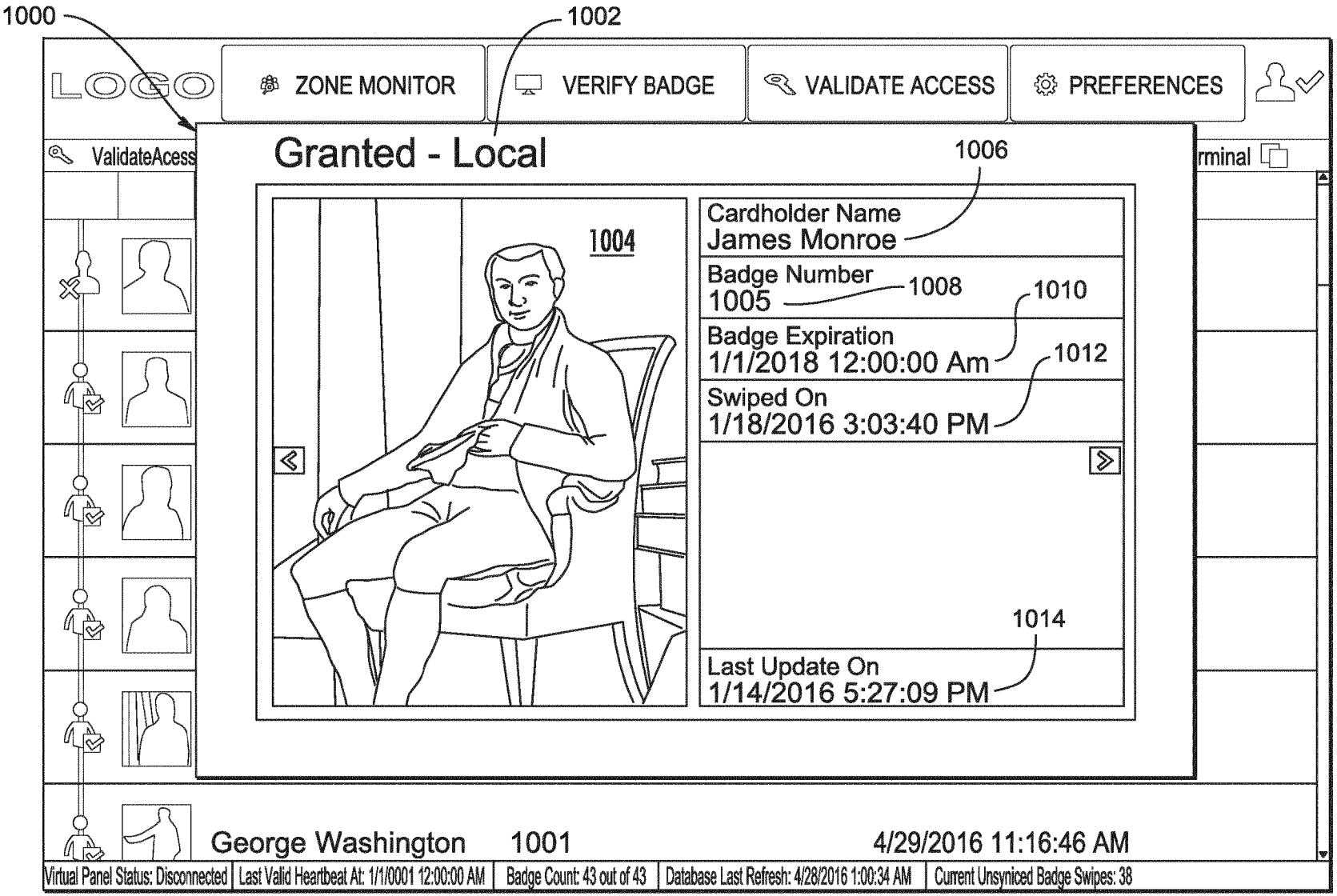
FIG. 10 is a drawing of a validation result interface which can be generated by the virtual panel of FIG. 2 and/or an application running on a mobile device, according to some embodiments.

Referring now to FIG. 10, another user interface 1000 which can be generated by virtual panel 216 and/or applications 218 is shown, according to some embodiments. User interface 1000 can be displayed in response to requesting badge validation/authorization. User interface 1000 is shown displaying a result 1002 of the badge validation request (i.e., "Granted-Local") as well as details associated with the request. For example, user interface 1000 can display an image 1004 of the user, the user's name 1006, the user's badge number, a badge expiration date 1010, a timestamp of the access request/grant 1012, and a time 1014 at which the information associated with the badge was last updated.

Figure 11:
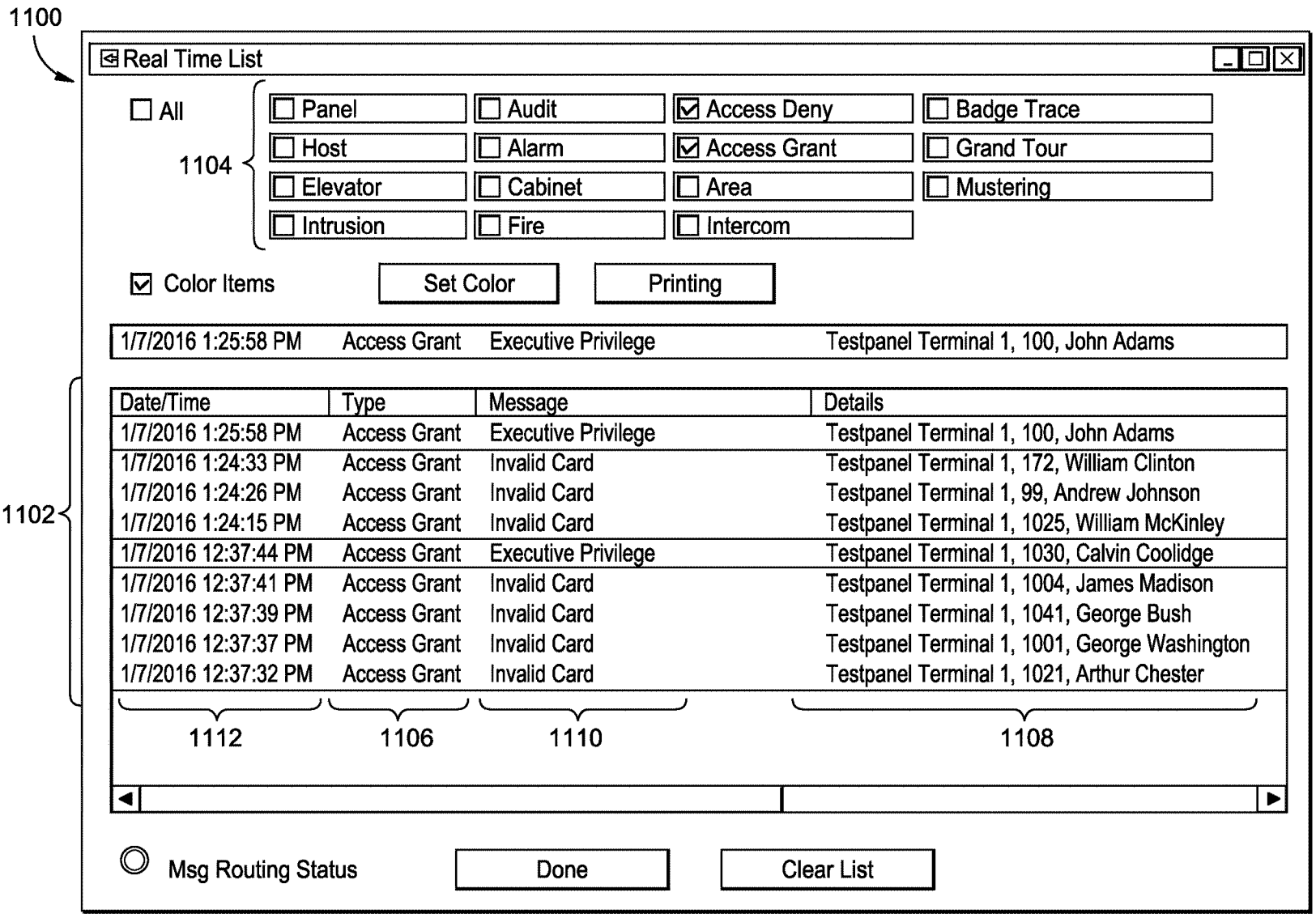
FIG. 11 is a drawing of an event log viewer interface which can be generated by the virtual panel of FIG. 2 and/or an application running on a mobile device, according to some embodiments.

Referring now to FIG. 11, another user interface 1100 which can be generated by virtual panel 216 and/or applications 218 is shown, according to some embodiments. User interface 1100 can be used to view the log 1102 of events stored in event database 304. Event log 1102 can be sorted or filtered by various attributes 1104 of the events such as the type of panel or emulation mode associated with the event (e.g., panel, host, elevator, intrusion, audit, alarm, cabinet, fire, intercom, area, etc.). The event attributed displayed in event log 1102 can include a result 1106 of the event (e.g., access grant, access deny), details 1108 associated with the event (e.g., user name, card ID, terminal ID, etc.), a reason or rule 1110 which indicates why the result 1106 occurred (e.g., invalid card, executive privilege, etc.), and/or a time 1112 at which the event occurred.

Figure 12:
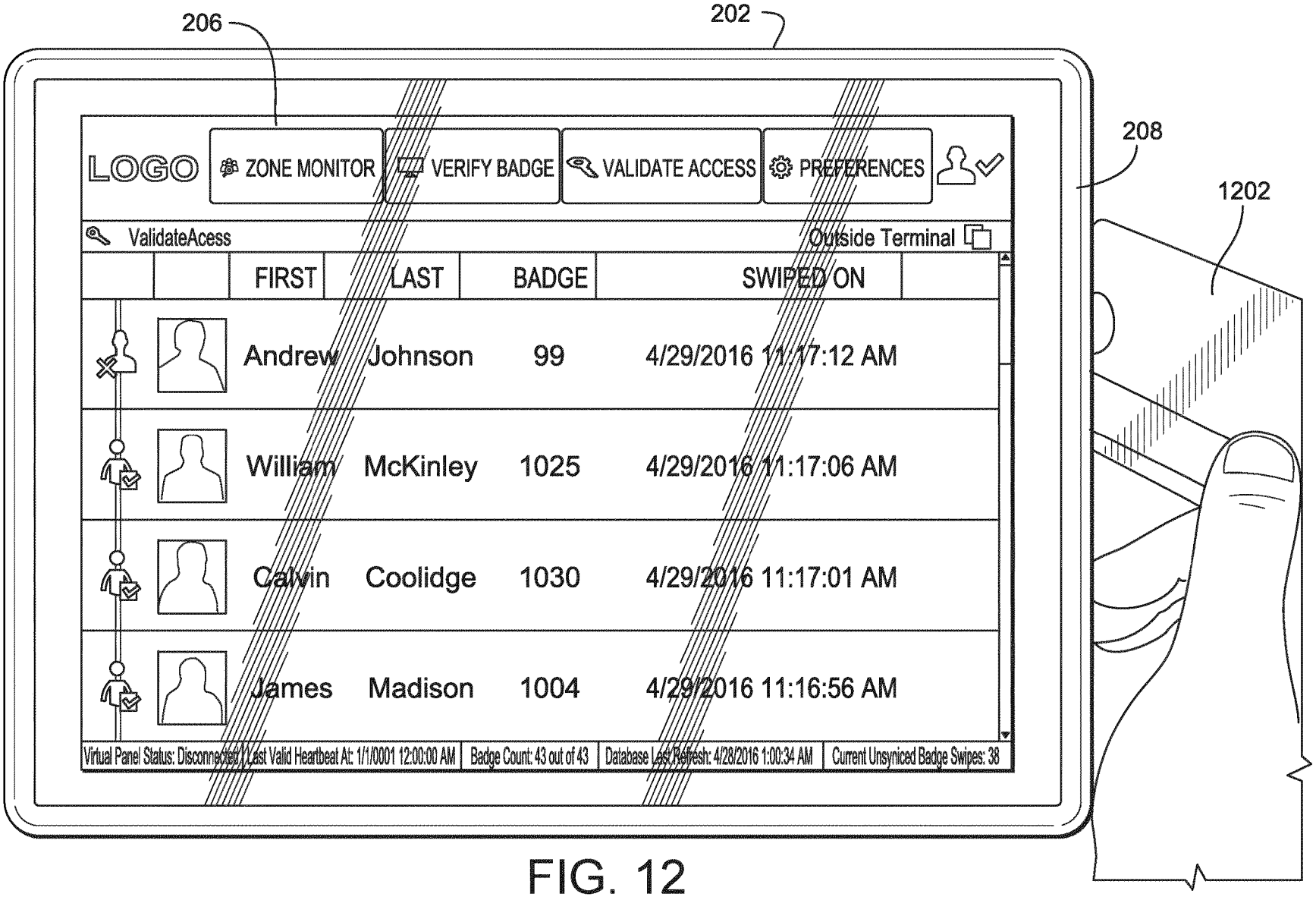
FIG. 12 is a drawing of a mobile device configured to run the virtual panel of FIG. 2, according to some embodiments.

Referring now to FIG. 12, a drawing of mobile device 202 is shown, according to an exemplary embodiment. In FIG. 12, mobile device 202 is shown as a tablet. Mobile device 202 can be configured to run virtual panel 216, as described with reference to FIG. 2. Mobile device 202 may include a user interface 206 and one or more readers 208 (e.g., proximity card reader 230, biometric reader 228, etc.). Any of the user interfaces shown in FIGS. 8-11 can be displayed via user interface 206 of mobile device 202. Readers 208 can be configured to read a badge or proximity card 1202 to obtain a credential from proximity card 1202. Mobile device 202 can use the credential to perform any of the processes described with reference to FIGS. 2-7.

Configuration of Exemplary Embodiments

The construction and arrangement of the systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

The present disclosure contemplates methods, systems and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. Combinations of the above are also included within the scope of machine-readable media. Machine-executable instructions include, for example, instructions and data which cause a general purpose computer, special purpose computer, or special purpose processing machines to perform a certain function or group of functions.

Although the figures show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

What is claimed is:

1. An access control system for a building or campus, the access control system comprising:

an access control host configured to interact with one or more physical control panels to monitor and control physical access to one or more locations of the building or campus; and a mobile device comprising a virtual panel configured to emulate one or more of the physical control panels to the access control host and perform one or more access control functions of the physical control panels, wherein the virtual panel configures the mobile device to operate as a portable control panel in the access control system, the virtual panel comprising:

a hardware emulator configured to exchange hardware-native data from the access control host and convert the hardware native data between hardware-native formats and standard formats, wherein the hardware-native formats are a communication protocol or messaging format native to the one or more physical panels emulated by the virtual panel; and an extended controller configured to exchange data from the access control host that is communicated in a format different from the hardware-native data.

2. The access control system of claim 1, wherein the mobile device comprises:

one or more readers configured to obtain a security credential from a user or from a security device possessed by the user; and one or more applications configured to use the security credential to generate a request for the virtual panel to perform one or more of the access control functions.

3. The access control system of claim 1, wherein the virtual panel is configured to operate as a portable mustering terminal by:

maintaining a first list of users located within one or more zones of the building or campus;

identifying one or more users who have checked-in with the virtual panel at a location outside the building or campus; and moving the identified users from the first list to a second list of users located outside the one or more zones of the building or campus.

4. The access control system of claim 1, wherein the virtual panel comprises:

a badge database configured to store a set of badge data for each of a plurality of badges, each set of badge data indicating whether the corresponding badge is authorized to access one or more locations of the building or campus; and a rules engine configured to:

receive a badge authorization request comprising badge data associated with a badge to be authorized;

compare the badge data received as part of the badge authorization request with the badge data stored in the badge database; and grant or deny access one or more locations of the building or campus based on whether the badge data associated with the badge to be authorized matches the badge data stored in the badge database.

5. The access control system of claim 1, wherein the virtual panel comprises:

a badge database configured to store a set of badge data for each of a plurality of badges; and a rules engine configured to:

receive a badge verification request comprising badge data associated with a badge to be verified;

compare the badge data received as part of the badge verification request with the badge data stored in the badge database; and provide a badge verification response indicating whether the badge data received as part of the badge verification request matches the badge data stored in the badge database.

6. The access control system of claim 1, wherein the virtual panel is configured to:

determine whether a communication link between the virtual panel and the access control host is active or inactive;

operate in an online mode in response to a determination that the communication link is active; and operate in an offline mode in response to a determination that the communication link is inactive.

7. The access control system of claim 6, wherein the virtual panel is configured to:

log event data generated by the virtual panel in an event database local to the virtual panel while operating in the offline mode; and forward the event data logged in the event database to the access control host in response to a determination that the communication link has been restored.

8. The access control system of claim 1, wherein the hardware emulator is configured to emulate hardware of the physical control panels and exchange data with the access control host in a hardware-native format native to the hardware of the physical control panels.

9. The access control system of claim 8, wherein the virtual panel comprises a badge database configured to store badge data for a plurality of badges that the virtual panel is configured to authorize or verify;

wherein the hardware emulator is configured to:

download badge data from the access control host in the hardware-native format;

convert the badge data into a standard format used by one or more other components of the virtual panel; and store the badge data in the badge database in the standard format.

10. The access control system of claim 9, wherein the virtual panel comprises an extended detail synchronization service configured to:

monitor the badge database for standard badge data that lacks extended badge details;

request the extended badge details from the access control host in response to detecting badge data that lacks extended badge details; and store the extended badge details in the badge database along with the standard badge data.

11. The access control system of claim 10, wherein:

the extended badge details comprise one or more types of badge data that cannot be communicated in the hardware-native format; and the extended controller of the virtual panel is configured to request the extended badge details from the access control host in a format other than the hardware-native format.

12. The access control system of claim 1, wherein the extended controller of the virtual panel is configured to exchange data with the access control host in a format other than a hardware-native format native to the hardware of the physical control panels.

13. A virtual panel for an access control system for a building or campus, the virtual panel comprising:

a hardware emulator configured to emulate hardware of one or more physical control panels of the access control system and exchange data with an access control host of the access control system in a hardware-native format native to the hardware of the physical control panels, wherein the hardware-native format is a communication protocol or messaging format native to the hardware of the physical control panels;

an extended controller configured to exchange data from the access control host that is communicated in a format different from the hardware-native data; and a rules engine configured to perform one or more access control functions of the physical control panels comprising at least one of a badge authorization function or a badge verification function.

14. The virtual panel of claim 13, further comprising a panel interface configured to receive a request for the virtual panel to perform one or more of the access control functions, the request comprising a security credential provided by a user or by a security device possessed by the user.

15. The virtual panel of claim 13, wherein the virtual panel is configured to operate as a portable mustering terminal by:

maintaining a first list of users located within one or more zones of the building or campus;

identifying one or more users who have checked-in with the virtual panel at a location outside the building or campus; and moving the identified users from the first list to a second list of users located outside the one or more zones of the building or campus.

16. The virtual panel of claim 13, further comprising a badge database configured to store a set of badge data for each of a plurality of badges, each set of badge data indicating whether the corresponding badge is authorized to access one or more locations of the building or campus;

wherein the rules engine is configured to:

receive a badge authorization request comprising badge data associated with a badge to be authorized;

compare the badge data received as part of the badge authorization request with the badge data stored in the badge database; and grant or deny access one or more locations of the building or campus based on whether the badge data associated with the badge to be authorized matches the badge data stored in the badge database.

17. The virtual panel of claim 13, further comprising a badge database configured to store a set of badge data for each of a plurality of badges;

wherein the rules engine is configured to:

receive a badge verification request comprising badge data associated with a badge to be verified;

compare the badge data received as part of the badge verification request with the badge data stored in the badge database; and provide a badge verification response indicating whether the badge data received as part of the badge verification request matches the badge data stored in the badge database.

18. The virtual panel of claim 13, further comprising an event database configured to log event data generated by the virtual panel;

wherein the virtual panel is configured to:

determine whether a communication link between the virtual panel and the access control host is active or inactive;

operate in an offline mode in response to a determination that the communication link is inactive, wherein operating in the offline mode comprises logging the event data to the event database; and operate in an online mode in response to a determination that the communication link is active, wherein operating in the online mode comprises forwarding the event data logged in the event database to the access control host upon restoration of the communication link.

19. The virtual panel of claim 13, wherein the virtual panel comprises a badge database configured to store badge data for a plurality of badges that the virtual panel is configured to authorize or verify;

wherein the hardware emulator is configured to:

download badge data from the access control host in the hardware-native format;

convert the badge data into a standard format used by one or more other components of the virtual panel; and store the badge data in the badge database in the standard format.

20. The virtual panel of claim 19, wherein the virtual panel comprises an extended detail synchronization service configured to:

monitor the badge database for standard badge data that lacks extended badge details, wherein the extended badge details comprise one or more types of badge data that cannot be communicated in the hardware-native format;

request the extended badge details from the access control host in response to detecting badge data that lacks extended badge details;

obtain the extended badge details from the access control host in a format other than the hardware-native format; and store the extended badge details in the badge database along with the standard badge data.

21. An access control system for a building or campus, the access control system comprising one or more memory devices configured to store instructions that, when executed by one or more processors, cause the one or more processors to:

interact with one or more physical control panels to monitor and control physical access to one or more locations of the building or campus;

emulate one or more of the physical control panels and perform one or more access control functions of the physical control panels so as to operate in the access control system;

exchange hardware-native data from the access control system and convert the hardware native data between hardware-native formats and standard formats, wherein the hardware-native formats are a communication protocol or messaging format native to the one or more physical panels; and exchange data from the access control system that is communicated in a format different from the hardware-native data.

22. The access control system of claim 1, wherein the mobile device is configured to:

obtain a security credential from a user or from a security device possessed by the user indicating a request for authentication;

capture an image of the user upon obtaining the security credential;

generate a request for the virtual panel to perform one or more of the access control functions for the security credential;

communicate the captured image of the user to the virtual panel, wherein the virtual panel is configured to associate the captured image of the user with the security credential and the request for the virtual panel to perform one or more of the access control functions; and display the captured image and security credentials on a user interface.

23. The virtual panel of claim 13, wherein the virtual panel is operable on a mobile device, the virtual panel configured to:

receive a request to perform one or more of the access control functions for a security credential obtained by the mobile device from a user or from a security device possessed by the user;

receive an image captured by the mobile device of the user upon obtaining the security credential from the user;

associate the image of the user with the security credential obtained by the mobile device and the request to perform one or more of the access control functions for the security credential; and generate a user interface for display on the mobile device, the user interface comprising the captured image and the security credentials.

* * * * *